US005212912A

United States Patent [19]

Foissac

[11] Patent Number: 5,212,912

[45] Date of Patent: May 25, 1993

[54] STRUCTURE INTENDED TO SUPPORT A DIRECTIONAL ANTENNA MOUNTED SUBSTANTIALLY AT THE TOP OF A MAST

[75] Inventor: Yves Foissac, Famars Valenciennes, France

[73] Assignee: Laboratoire D'Etudes et de Recherches Chiminques (Lerc), S.A., St. Amand Les Eaux, France

[21] Appl. No.: 622,800

[22] Filed: Dec. 5, 1990

[30] Foreign Application Priority Data

Dec. 7, 1989 [FR] France ..... 89 16742

[51] Int. Cl.[5] ..... E04H 12/00

[52] U.S. Cl. ..... 52/40; 248/121; 343/874

[58] Field of Search ..... 52/40; 343/874; 428/121, 122

[56] References Cited

U.S. PATENT DOCUMENTS

| | | | |
|---|---|---|---|
| 2,204,026 | 6/1940 | Peters | 343/874 |
| 2,650,051 | 8/1953 | Zarobsky et al. | 52/40 |
| 2,844,819 | 7/1958 | Andrews | 343/874 |
| 4,649,675 | 3/1987 | Moldovan et al. | 52/40 |

*Primary Examiner*—Michael Safavi

*Attorney, Agent, or Firm*—Kerkam, Stowell, Kondracki & Clarke

[57] ABSTRACT

The invention relates to a structure intended to support a directional apparatus such as an antenna placed substantially at the top of a mast. In addition to girders (4) orthogonal to the mast (3), a plurality of elements (12) for wind bracing are provided that extend a plane (P1) defined by the girders (4). Assuming the mast to be in the erected position, each of the wind bracing elements (12) is interposed via removable connection means (13, 14) between one end (8) of the girders, a fixed point (9), which may be at ground level, and the mast, substantially below a zone (15) of the mast (3) above which the directional apparatus (2) is supported. Each wind bracing element is connected to the fixed point (9) by at least one group of guy wires. Each group of guy wires is located in a plane that bisects the dihedron coinciding with the longitudinal (vertical) axis of the mass and passes through the axes of the guy wires. The guy wires of each group are in turn located, radiating around the mast, on either side of a plane that is radial to the mast and that contains the girder and the associated wind bracing element.

24 Claims, 2 Drawing Sheets

STRUCTURE INTENDED TO SUPPORT A DIRECTIONAL ANTENNA MOUNTED SUBSTANTIALLY AT THE TOP OF A MAST

FIELD OF THE INVENTION

The invention relates to a structure intended to support an apparatus with directional effects that is mounted substantially at the top of a mast. More particularly, but not exclusively, the invention relates to structures constituted to support directional radioelectrical antennas.

BACKGROUND OF THE INVENTION

The action of the wind on mast mounted antennas, and more particularly antennas that include a parabolic reflector, generally causes elastic torsion of the mast. This torsion changes the aim of the antenna and as a result causes the loss of all or some of the information transmitted or received through it.

To overcome such mast torsion, it is known provide the upper end of a mast with a structure that accurately prevents torsion of the upper end about the longitudinal axis of the mast. Conventionally, this structure includes a plurality of girders that extend substantially orthogonally and radially to the longitudinal axis of the mast in a generally regular angular distribution. Each girder is associated with the mast at one of its ends via a connection means of the receptacle type. The opposite end of the girder is connected to a fixed point with respect to the foot of the mast, in particular via a taut cable known as a guy wire.

Although such a structure enables the torsion of the mast to be effectively prevented, it does not prevent flexion of the mast, especially at its end portion located above this torsion preventing structure.

OBJECT AND SUMMARY OF THE INVENTION

To overcome this problem, the subject invention is a structure of the above described type for preventing torsion which is further characterized in that the torsion preventing girders that are orthogonal to the mast are connected to a plurality of wind bracing elements, each of which extend above a plane defined by the aforementioned girders, assuming the mast to be in its vertical or erected position. Each of the wind bracing elements is interposed via removable connection means between one of the girders towards its end connected to the fixed point, on the one hand, and the mast, on the other, substantially below the zone of the mast above which the directional apparatus is supported.

The invention will be better understood from the ensuing detailed description of a non-limiting exemplary embodiment, taken in conjunction with the drawings.

DESCRIPTION OF THE PREFERRED EMBODIMENT

Figure 2:
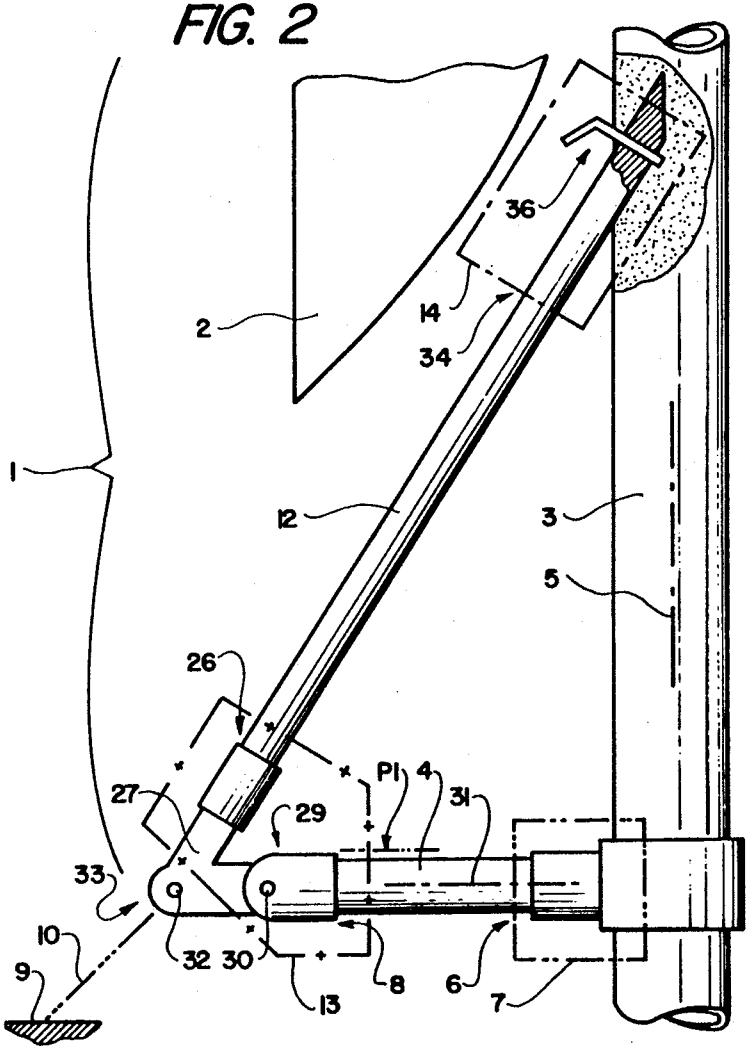
FIG. 2 is a fragmentary sectional elevational view of the subject invention.
Figure 1:
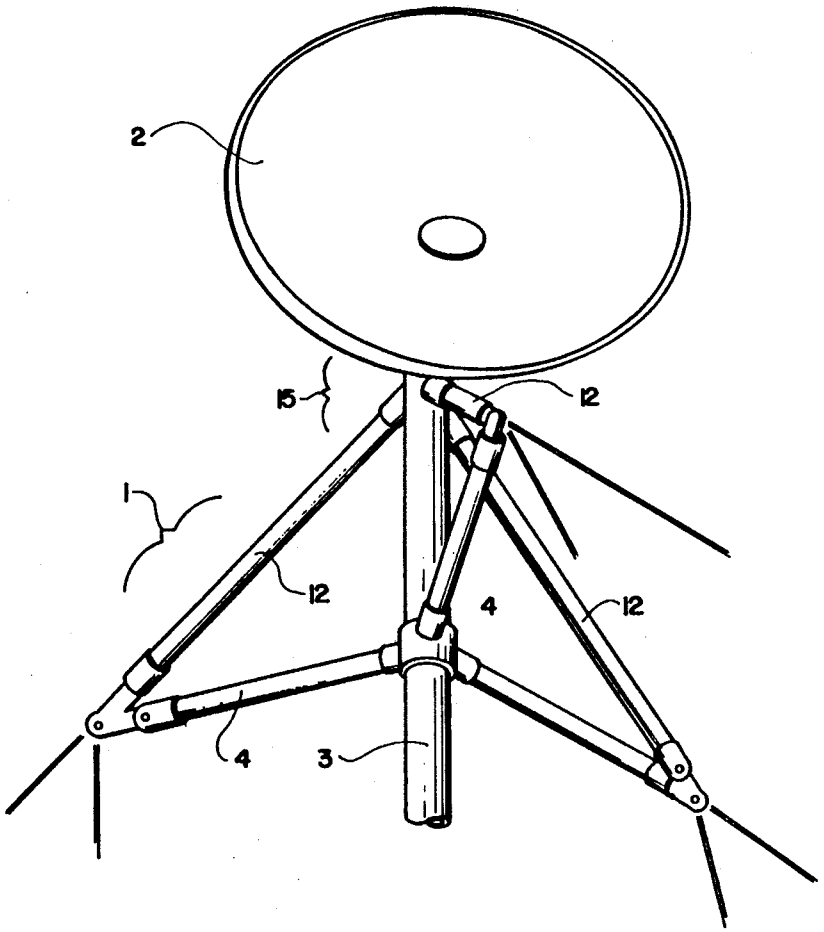
FIG. 1 is a perspective view of the subject invention.

Turning to the drawings, FIG. 1 shows a structure 1 intended, at least indirectly, to support at least one apparatus 2 with directional effects such as a directional antenna disposed or mounted substantially at the top of a mast 3 that is approximately vertical and in the form of a cylinder of revolution.

As can be seen from the drawings, in the conventional manner the structure 1 includes a plurality of elongated, rigid girders 4 that extend substantially radially to the longitudinal axis 5 of the mast 3, and in a generally regular angular distribution about the axis of the mast. Each girder is connectively associated, at one of its ends 6, with the mast 3 via a connection means 7 of the receptacle type. The opposite end 8 of each girder is connected to a point 9 that is fixed with respect to the foot of the mast, and in particular to the ground, via a taut cable 10 known as a guy wire.

According to the invention, in addition to the torsion preventing girders 4 that are orthogonal to the mast 3, the structure 1 includes a plurality of wind bracing elements 12 each of which extends above a plane P1 defined by the aforementioned girders 4, the mast being assumed to be in the vertical or erected position. Each of the elements 12 is interposed via removable connection means 13, 14 between one of the girders towards its end 8 connected to the fixed point 9, on the one hand, and the mast, on the other, substantially below the zone 15 of the mast 3 vertically of or above which the directional apparatus 2 is supported.

The dimensions of the girders and wind bracing elements necessary to assure the desired rigidity and arranged so as not to prevent the orientation of the directional apparatus about the longitudinal axis of the mast will be readily ascertainable by one skilled in the art.

The means 7 for connecting the girders 4 to the mast 3 comprises a multi part ring or collar 16. Each of the ends of a girder cooperating with the mast 3 is connected to a part or segment of the collar 16 supported on the cylindrical wall 17 of the mast 3, along a cylindrical sector C extending over a predetermined angular faction. The separate parts or segments of the collar are joined or connected together to fasten the girders to the mast. To this end, the support parts or segments of collar 16 include means 18, 19 adapted for assembly with one another and for pressing the parts of collar 16 forcefully against the cylindrical wall 17 of the mast.

For example, each support part 16 extends over a fraction of the perimeter of the mast with respect to the number of girders 4 disposed radially about the mast.

Figure 4:
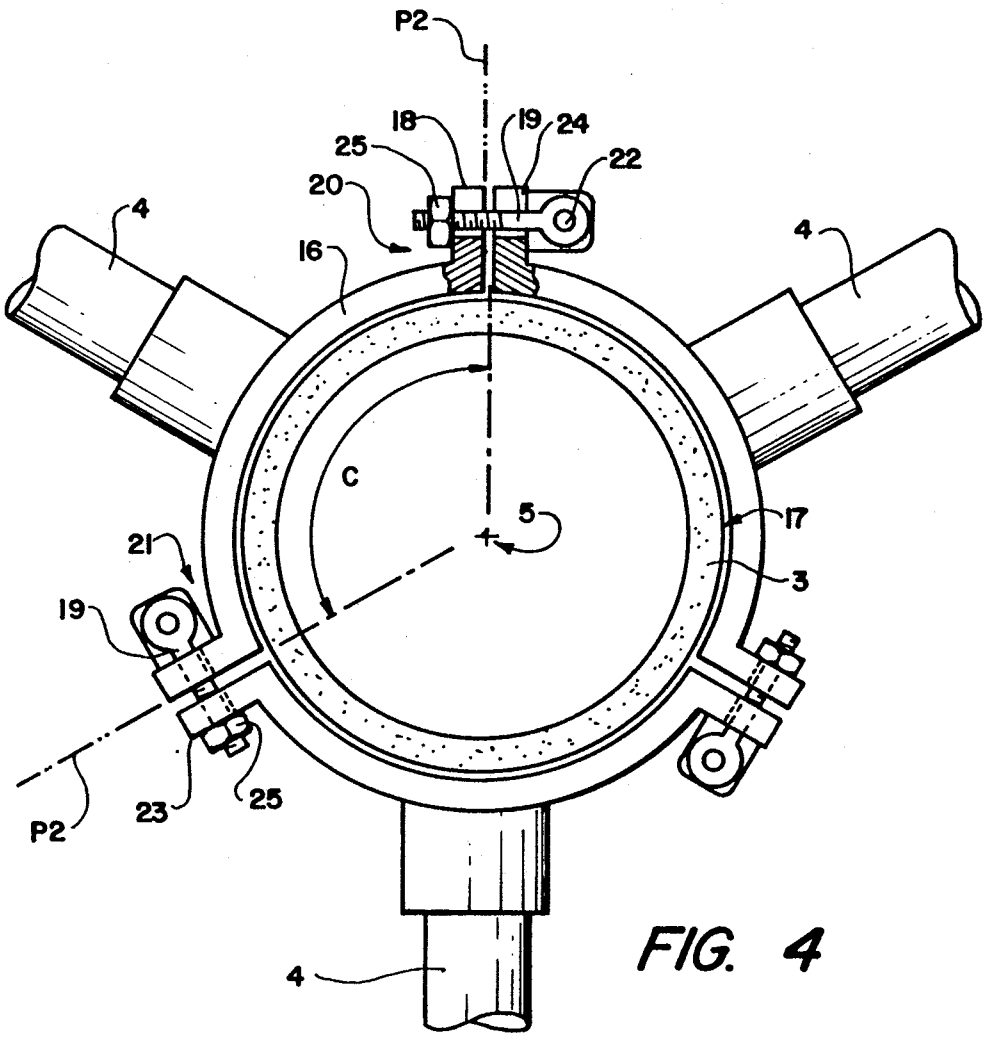
FIGS. 3 and 4 show details of an embodiment of the invention, on different scales.

In a preferred embodiment, as best shown in FIG. 4, each support part of collar 16 comprises a segment of a cylindrical ring having an inside diameter substantially equivalent to the outside diameter of the segment of the mast 3 with which it is to cooperate so that the collar 16 may be clamped to the mast. Each of ends 20, 21 of the ring segments has an outwardly extending lug 18 that extends in a plane P2 radial to the longitudinal axis 15 of the ring and passes along this axis. Each of the lugs include bearing surfaces 23 and/or cutouts 24 for the support and passage of at least one assembly device 19 intended to cooperate with one of the facing lugs, that is, one located on another ring segment. The various aforementioned components comprise the means 18, 19 for assembling the elements of the support part with one another and for pressing the collar 16 forcefully against the outside surface of the mast.

The assembly devices 19 may, for example, as shown in FIG. 4, comprise eye-bolts, each of them pivotally connected to a shaft 22 that is solidly attached to one of the lugs 18 of each ring segment of the collar 16. Each of these bolts 19 has threaded thereon a nut 25 intended for cooperation with the bearing surface 23 of an antagonist lug. A cutout 24 in the lugs is made to enable rapid engagement of the assembly device 19. Disassembly of the support part of collar 16 is easily effected by loosening nut 25 and pivoting the eye-bolt about its pivot away from the lugs. Assembly of the support parts requires the reverse sequence, i.e. with a loosened nut, the eye-bolt is swung on its pivot into the cutout and nut 25 is tightened down against the bearing surface 23, thus drawing the ring against the mast surface 17.

According to the invention, the means 13 for connection between the lower end 26 of a wind bracing element 12 and the end 8 of each girder radial to the mast includes a two arm part 27 which is "v" shape. One arm of part 27 is solidly attached to the lower end 28 of the wind bracing element 12, in particular via a connection of the receptacle type. The other arm of part 27 which forms an acute angle with the first part cooperates with the associated end of the radial girder 4, via a connecting means 29 capable of articulation about an axis 30 that is substantially horizontal and perpendicular to the longitudinal axis 31 of the girder 4. Part 27 includes at least one bearing surface 32 at the juncture of the two arms for at least indirect anchoring the end 33 of a guy wire 10, the other end of which may be tied to a fixed point relative to the base of the mast, such as the ground.

Figure 3:
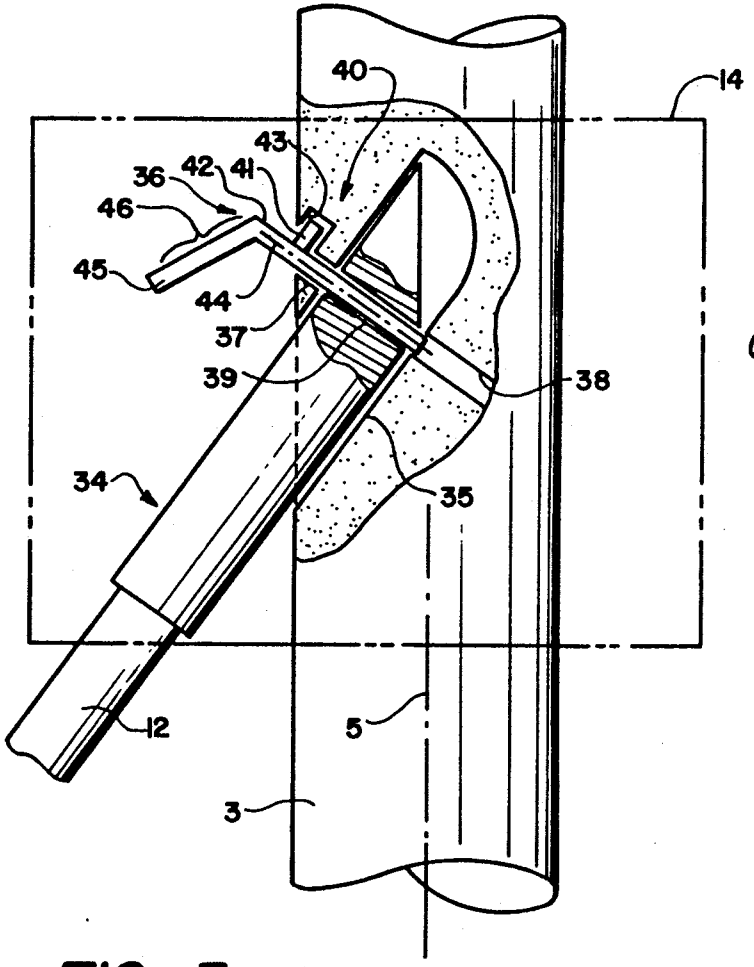

According to the invention, as best shown in FIG. 3, the means 14 for connecting the upper end 34 of each wind bracing element 12 includes, on the one hand, a reserved downwardly inclined hole 35 in the mast 3 which extends along the inclination and orientation of the element with respect not only to the longitudinal axis 5 of the mast but also to the other wind bracing elements 12 (as shown in FIG. 3). Hole 35 has a cross section at least sufficient for internesting cooperation with the upper end 34 of one element 12, and on the other, at least one means 36 for controlled immobilization in the internested position of the upper end of the element 12 in the applicable hole 35 of the mast. Immobilization means 36 is adapted to be received in aligned downwardly inclined holes 37 and 38 which are smaller in diameter than hole 35 and aligned along a common axis so as to receive the immobilization pin 36.

According to the invention, the means for controlled immobilization associated with each means 14 for connection of the other end of each wind bracing element to the mast comprises a pin 36 that is accommodated in aligned holes 37, 38, 39, that is, in the reserved holes 37, 38 in the mast and in the hole 39 located transversely in the upper end of each wind bracing element 12 when inserted in hole 35.

According to the invention, each pin 36 has a means 40 for translational locking of the pin in the aligned hole 39 of the mast and 37, 38 of the corresponding upper end 34 of a wind bracing element. The locking means 40 is of the oscillating bolt type, that is, is adapted to be inserted into the aligned holes 37, 38, 39 and turned when locking the end of a wind bracing element 34 in place and to be turned and withdrawn for releasing the element 34. To this end, each pin 36 includes an axial stop 41 that extends radially from the pin and is located on its flank 42. The mast 3 has at least one cooperating stop 43, disposed vertically and adjacent each aligned hole of the mast intended to receive the pin. The back of each stop 43 is adapted to be engaged by the stop 41 of the pin 36 upon rotational movement of pin 36 of a predetermined amplitude about its axis 44, after engagement of the pin in the immobilization position of the upper end of an element in a hole of the mast.

The pin 36 has at least one weight 45, slantwise of flank 42 to form lever 46, that is so oriented that, by gravity, it induces the rotation of the pin in the locking position and/or assures that the pin is held in this position. For example, the weight comprises a free end section of the pin that is bent in such a manner as to be offset with respect to the longitudinal axis of the pin and thus at least indirectly to constitute the aforementioned lever 46.

In a preferred embodiment, when the mast is erected and the structure is installed, the holes 37, 38, 39 provided in the mast and in each upper end of a wind bracing element for receiving a pin are inclined downward from where they begin. Holes 37 and 39 are located on opposite sides of hole 35 which is inclined upward from where it begins as shown in FIG. 3, such that the axis of the aligned holes 37, 39 is substantially at a right angle to the axis of the hole 35. Each means 13 for connection between a girder 4 and a wind bracing element is connected to the support 9 by at least one group of two guy wires 10. Each group of guy wires is located in a plane that at least bisects the dihedron coinciding with the axis of the mast and passing through the axes of the guy wires of the mast, which are located, radiating around the mast, on either side of the plane that is radial to the mast and that contains the girder and the applicable wind bracing element This disposition of the ties guarantees optimum stability of the structure.

What is claimed is:

1. A structure (1) adapted to support at least one directional apparatus (2) substantially at the top of a mast (3) having a longitudinal axis that is approximately vertical in its supporting position and in the form of a cylinder of revolution, comprising a plurality of elongated, rigid girders (4) extending substantially radially to the longitudinal axis (5) of the mast (3) in a plane (P1) and in a generally regular angular distribution about said axis, each girder being connected at one end (6), with said mast via a connection means (7) of the receptacle type, each girder being connected at an opposite end (8) to a point (9) that is fixed with respect to the foot of the mast and in particular to ground via a guy wire, a plurality of wind bracing elements (12), each said wind bracing elements (12) being interposed via removable connection means (13, 14) between said opposite end (8) of one of the girders, a fixed point (9) remote of the mast and the mast, said element adapted to be connected to the mast substantially below a zone (15) of the mast (3) above which the directional apparatus (2) is supported, said connector means (7) including at each end of a girder (4) intended for connection with said mast (3) a support part (16) supported on the cylindrical wall (17) of the mast (3), along a cylindrical sector extending over a predetermined angular fraction thereof, each said support part (16) including means (18, 19) for assembly with another support part and for pressing the support parts forcefully against the outer cylindrical wall (17) of the mast (3).

2. The structure of claim 1, wherein each support part (16) comprises a ring segment, said ring segments adapted to form a cylindrical ring about the mast having an inside diameter substantially equivalent to that of the outside diameter of the mast (3) with which it is to cooperate, each ring segment including a lug (18) at each end that extends in a plane (P2) radial to the longitudinal axis (15) of the mast, each said lug having bearing surfaces (23) and/or cutouts (24) for the support and passage of at least one assembly device (19) intended to cooperate with an adjacent lug (18) of another adjacent ring segment, for assembling the support parts with one another and for forcefully pressing the assembled support parts against the wall of the mast.

3. The structure of claim 2, characterized in that the removable connection means (13) connecting means disposed between the lower end (26) of a wind bracing element (12) and said opposite end (8) of each girder radial to the mast includes a first arm (27) fixedly attached to the lower end (28) of the wind bracing element (12), and a second arm (27) connected with the opposite end of the associated radial girder (4), via means (29) for articulation about an axis (30) that is substantially horizontal and perpendicular to a longitudinal axis (31) of said girder, and said connection means (13) further including at least one bearing surface (32) for anchoring an end (33) of the connection means to said point (9) via a guy wire (10).

4. The structure of claim 1, characterized in that the removable connecting means (14) includes means for connecting the upper end (34) of each wind bracing element (12) to the mast including a reserved hole (35) in the mast (3) along the inclination and orientation of the element with respect to the longitudinal axis (5) of the mast and the other wind bracing elements (12), said reserved hole having a cross section at least sufficient for internesting cooperation with the upper end (34) of the associated bracing element (12), and said means for connecting the upper end of each element to the mast further including at least one means (36) for controlled immobilization of the element in the internested position of the upper end of the wind bracing element.

5. The structure of claim 1, characterized in that the removable connecting means (14) includes means for connecting the upper end (34) of each wind bracing element (12) to the mast including a reserved hole (35) in the mast (3) along the inclination and orientation of the element with respect to the longitudinal axis (5) of the mast and the other wind bracing elements (12) said reserved hole having a cross section at least sufficient for internesting cooperation with the upper end (34) of the associated bracing element (12), and said means for connecting the upper end of each element to the mast further including at least one means (36) for controlled immobilization of the element in the internested position of the upper end of the wind bracing element 6. The structure of claim 2, characterized in that the removable connecting means (14) includes means for connecting the upper end (34) of each wind bracing element (12) to the mast including a reserved hole (35) in the mast (3) along the inclination and orientation of the element with respect to the longitudinal axis (5) of the mast and the other wind bracing elements (12) said reserved hole having a cross section at least sufficient for internesting cooperation with the upper end (34) of the associated bracing element (12), and said means for connecting the upper end of each element to the mast further including at least one means (36) for controlled immobilization of the element in the internested position of the upper end of the wind bracing element.

7. The structure of claim 4, characterized in that the means (36) for controlled immobilization associated with each removable connecting means (14) includes aligned holes 37, 38 in the mast and a transverse hole in the upper end of the bracing element (12) adapted to be aligned with holes 37, 38, a pin (36) adapted to be accommodated in the aligned (37, 38) in the mast and in the hole (39) located transversely in the upper end of the associated wind bracing element (12).

8. The structure of claim 5, characterized in that the means (36) for controlled immobilization associated with each removable connecting means (14) includes aligned holes 37, 38 in the mast and a transverse hole in the upper end of the bracing element (12) adapted to be aligned with holes 37, 38, a pin (36) adapted to be accommodated in the aligned (37, 38) in the mast and in the hole (39) located transversely in the upper end of the associated wind bracing element (12).

9. The structure of claim 6, characterized in that the means (36) for controlled immobilization associated with each removable connecting means (14) includes aligned holes 37, 38 in the mast and a transverse hole in the upper end of the bracing element (12) adapted to be aligned with holes 37, 38, a pin (36) adapted to be accommodated in the aligned (37, 38) in the mast and in the hole (39) located transversely in the upper end of the associated wind bracing element (12).

10. The structure of claim 7, characterized in that each pin (36) has a locking means (40) for translational locking of the corresponding upper end (34) of a wind bracing element to the mast.

11. The structure of claim 8, characterized in that each pin (36) has a locking means (40) for translational locking of the corresponding upper end (34) of a wind bracing element to the mast.

12. The structure of claim 9, characterized in that each pin (36) has a locking means (40) for translational locking of the corresponding upper end (34) of a wind bracing element to the mast.

13. The structure of claim 10, characterized in that the locking means (40) is of the oscillating bolt type, wherein each pin includes a flank (42) and an axial stop (41) extending radially and locally on the flank (42), and said mast includes at least one stop (43), disposed above each group of aligned holes of the mast intended to receive the pin, said stop having a back surface adapted to be engaged by the stop (41) of the pin (36) upon a rotational movement of predetermined amplitude, after engagement of said pin in an immobilization position of the upper end of a bracing element in a reserved hole (35) of the mast, and said pin (36) including a weight (45), slantwise of the flank such that said weight oriented by gravity induces rotation of the pin to the locking position.

14. The structure of claim 11, characterized in that the locking means (40) is of the oscillating bolt type, wherein each pin includes a blank (S42) and an axial stop (41) extending radially and locally on the flank (42), and said mast includes at least one stop (43), above each group of aligned holes of the mast intended to receive the pin, said stop having a back surface adapted to be engaged by the stop (41) of the pin (36) upon a rotational movement of predetermined amplitude, after engagement of said pin in an immobilization position of the upper end of a bracing element in a reserved hole (35) of the mast, and said pin (36) including a weight (45), slantwise of the flank such that said weight oriented by gravity, induces rotation of the pin to the locking position.

15. The structure of claim 12, characterized in that the locking means (40) is of the oscillating bolt type, wherein each pin includes a blank (S42) and an axial stop (41) extending radially and locally on the flank (42), and said mast includes at least one stop (43), above each group of aligned holes of the mast intended to receive the pin, said stop having a back surface adapted to be engaged by the stop (41) of the pin (36) upon a rotational movement of predetermined amplitude, after engagement of said pin in an immobilization position of the upper end of a bracing element in a reserved hole (35) of the mast, and said pin (36) including a weight (45), slantwise of the flank such that said weight oriented by gravity induces rotation of the pin to the locking position.

16. The structure of claim 13, characterized in that the aligned holes (37, 38, 39) for receiving a pin that are provided in that mast and in each upper end of a wind bracing element for receiving a pin are inclined downward when the mast is erected and the structure is assembled to the mast.

17. The structure of claim 1, characterized in that each removable connecting means (13) for connection between a girder (4) and a wind bracing element is connected to the point (9) by at least one group of two guy wires (10), and each group of guy wires is located in a plane that bisects a dihedron coinciding with the longitudinal axis of the mast and passes through axes of the guy wires, which are located, radiating around the mast, on either side of a plane that is radial to the mast and that contains the girder and the associated wind bracing element.

18. The structure of claim 3, characterized in that each removable connecting means (13) for connection between a girder (4) and a wind bracing element is connected to the point (9) by at least one group of two guy wires (10), and each group of guy wires is located in a plane that bisects a dihedron coinciding with the longitudinal axis of the mast and passes through axes of the guy wires, which are located, radiating around the mast, on either side of a plane that is radial to the mast and that contains the girder and the associated wind bracing element.

19. The structure of claim 4, characterized in that each removable connecting means (13) for connection between a girder (4) and a wind bracing element is connected to the point (9) by at least one group of two guy wires (10), and each group of guy wires is located in a plane that bisects a dihedron coinciding with the longitudinal axis of the mast and passes through axes of the guy wires, which are located, radiating around the mast, on either side of a plane that is radial to the mast and that contains the girder and the associated wind bracing element.

20. The structure of claim 7, characterized in that each removable connecting means (13) for connection between a girder (4) and a wind bracing element is connected to the point (9) by at least one group of two guy wires (10), and each group of guy wires is located in a plane that bisects a dihedron coinciding with the longitudinal axis of the mast and passes through axes of the guy wires, which are located, radiating around the mast, on either side of a plane that is radial to the mast and that contains the girder and the associated wind bracing element.

21. The structure of claim 10, characterized in that each removable connecting means (13) for connection between a girder (4) and a wind bracing element is connected to the point (9) by at least one group of two guy wires (10), and each group of guy wires is located in a plane that bisects a dihedron coinciding with the longitudinal axis of the mast and passes through axes of the guy wires, which are located, radiating around the mast, on either side of a plane that is radial to the mast and that contains the girder and the associated wind bracing element.

22. The structure of claim 13, characterized in that each removable connecting means (13) for connection between a girder (4) and a wind bracing element is connected to the point (9) by at least one group of two guy wires (10), and each group of guy wires is located in a plane that bisects a dihedron coinciding with the longitudinal axis of the mast and passes through axes of the guy wires, which are located, radiating around the mast, on either side of a plane that is radial to the mast and that contains the girder and the associated wind bracing element.

23. A structure (1) adapted to support at least one directional apparatus (2) substantially at the top of a substantially vertical, cylindrical mast (3), said structure comprising a plurality of elongated rigid girders (4) having their longitudinal axes extending substantially radially to the longitudinal axis (5) of the mast (3) and in a generally regular angular distribution and each having one end (6) connected with said mast through a connecting means (7) of the receptacle type and each having its opposite end (8) connected to a point (9) fixed in relation to the foot of the mast and in particular to ground via a guy wire, a plurality of wind bracing elements (12) each extending above a plane (P1) defined by said girders (4), said wind bracing elements being connected to the mast (3) by removable connecting means (14) substantially below the zone (15) of said mast (3) above which the directional apparatus (2) is supported, each said wind bracing element (12) being connected by a removable connecting means (13) to one of said girders (4) at an end (8) connected to the fixed point (9), said removable connecting means providing connection between said guy wire and said girder.

24. The structure of claim 23, wherein the connection means (7) for connecting the girders (4) to the mast (3), includes at each end of a girder intended for connection with said mast (3) a support part (16) supported on the cylindrical wall (17) of the mast (3), along a cylindrical sector extending over a predetermined angular fraction, each said support part (16) including means (18, 19) for assembly with another support part and for pressing the parts forcefully against the outer cylindrical surface (17) of the mast.

* * * * *

UNITED STATES PATENT AND TRADEMARK OFFICE

CERTIFICATE OF CORRECTION

PATENT NO. : 5,212,912

DATED : May 25, 1993

INVENTOR(S) : Yves FOISSAC

It is certified that error appears in the above-identified patent and that said Letters Patent is hereby corrected as shown below:

Title page, item [57], col. 2,
In the Abstract, line 5 after "extend" insert --above--.

Signed and Sealed this

Seventeenth Day of May, 1994

Bruce Lehman

*Attest:*

BRUCE LEHMAN

*Attesting Officer*

*Commissioner of Patents and Trademarks*